United States Patent [19]

Langhoff et al.

[11] 4,424,065

[45] Jan. 3, 1984

[54] METHOD FOR THE GASIFICATION AND PREPARATION OF A WATER-CARBON SLURRY

[76] Inventors: Josef Langhoff, Kleinbergerhof 10, 4220 Dinslaken; Jürgen Seipenbusch, Falterweg 17, 4300 Essen 14, both of Fed. Rep. of Germany

[21] Appl. No.: 302,047

[22] Filed: Sep. 14, 1981

Related U.S. Application Data

[63] Continuation-in-part of Ser. No. 198,609, Oct. 20, 1980, abandoned, Continuation of Ser. No. 28,193, Apr. 9, 1979, abandoned.

[30] Foreign Application Priority Data

Apr. 8, 1978 [DE] Fed. Rep. of Germany ..... 2815329

[51] Int. Cl.[3] ..... C10J 3/46

[52] U.S. Cl. ..... 48/197 R; 48/202; 48/206; 48/DIG. 7; 252/373

[58] Field of Search ..... 48/202, 203, 206, 197 R, 48/62 R, 73, 76, DIG. 7; 252/373; 209/3, 5, 172, 207; 210/320, 335

[56] References Cited

U.S. PATENT DOCUMENTS

| | | | |
|---|---|---|---|
| 3,527,348 | 9/1970 | Lalonde et al. | 210/320 |
| 3,929,429 | 12/1975 | Crouch | 48/202 |
| 3,951,617 | 4/1976 | Crouch | 48/197 R |
| 4,111,665 | 9/1978 | Pasternak et al. | 48/77 |
| 4,187,080 | 2/1980 | Hafke et al. | 48/206 |

FOREIGN PATENT DOCUMENTS 2815329 10/1979 Fed. Rep. of Germany .

*Primary Examiner*—Peter F. Kratz
*Attorney, Agent, or Firm*—Jon M. Lewis

[57] ABSTRACT

A method of particulate-carbon recovery from the product gas in a coal gasification process of the type using water-carbon slurry combusted with oxygen in a reactor uses water scrubbing for the product gas to obtain particulate carbon together with ash. Certain ash content is trapped in carbon particles which have a tendency of lumping together. The carbon and ash fraction is treated with liquid hydrocarbon for carbon particle wetting and facilitating separation of ash. The recovered carbon is ground to break down bigger carbon particles and sent through a wet-particle separator; carbon particles which pass a predetermined mesh size, e.g., approximately 63 micron mesh, are sent back to the reactor for mixing with the water-carbon slurry inlet for further combustion. The bigger fractions of carbon are either ground down to size again, or diverted for other uses. Recycling carbon particles which pass a 63 micron mesh and are almost devoid of ash improves the carbon utilization and significantly reduces total ash formed. The abrasion damage on components because of ash is also reduced.

19 Claims, 2 Drawing Figures

METHOD FOR THE GASIFICATION AND PREPARATION OF A WATER-CARBON SLURRY

This specification is a continuation-in-part of U.S. application Ser. No. 198,609 filed on Oct. 20, 1980 which is a continuation of Ser. No. 028,198 filed on Apr. 9, 1979 both now abandoned.

FIELD OF THE INVENTION

This invention relates generally to gasification of carbonaceous materials, and more particularly, to apparatus and method for the gasification of a water-carbonaceous slurry.

DESCRIPTION OF THE PRIOR ART

The gasification of carbonaceous materials and minerals is well known and has been practiced for many decades. In the practice of prior art gasification of coal having a high ash content, partially gasified feed stock is recovered and fed back into the gasification process once more. This high ash content has created numerous problems in the processing of the partially reacted solids from the initial gasification step. This ash is extremely abrasive and prior art attempts to process the partially combusted feed stock has been thought to have resulted in the high wear of the apparatus to do such processing because ash contents of 40% are not unusual. Also during the gasification process, the pulverized carbonaceous material, generally coal, agglomerates or lumps. It has been found by the present inventors that this agglomeration somewhat increases the ash content of the partially gasified carbonaceous material. The use of grinders and other processing equipment to modify the particle size and content is believed to result in very uneconomical operation because of the high ash content which quickly wears away at the surfaces of the processing apparatus and makes them wear out within a relatively short period of time. The wearing out of the processing equipment greatly increases the cost of gasification of coal and makes this gasification of coal somewhat expensive and not competitive with other means of gasification, especially for producing gases which are then used for the manufacture of synthetic materials.

It is well known that the petrochemical industry has been a great provider of raw materials for the manufacture of synthetics. With the increase in the price of crude oil over the last several years, the need for a method of gasifying coal which is economical and efficient is greatly needed in order to provide an alternative and ultimately a superior means of providing the raw material gas for the production of these synthetic materials.

A well known means of coal gasification is practiced by feeding a slurry of coal and water into a gasification reactor chamber where the coal slurry and water, preferably with the air injected thereinto, all flow in the same direction from the top of the reactor to the bottom. These components are combusted in order to form a final product, a gas, containing carbon monoxide and hydrogen. The slurry is pumped into the reactor where it is reacted or at least partially combusted very rapidly with oxygen and probably the water vapor contained therein, so that the combusted materials pass through the reactor is just a few seconds. Because of this inherently very rapid reaction, a significant portion of the solid material which is discharged from the reactor contains a solid having a large carbonaceous component.

The solid materials which are carried along with the gas are quenched and scrubbed from the gas by the addition of water in a scrubber, thereby removing the particles from the gas. The water-solid matter mixture, which is removed from the scrubber, is then treated in order to remove a part of the water therefrom, thereby forming a slurry of unburned particles from the reactor. Through the feeding back of the carbonaceous portion of the solid materials recovered from the scrubber, close to 100% of the carbon can be ultimately reacted to produce the gas desired.

An example of prior art is German Pat. No. 12 16 259 which teaches a method of preparing a known type of water-carbon suspension which, after the wash-water dispersion, next adds gasoline or a higher petroleum distillate fraction to the slurry, and the combination is then mixed, whereupon the coal then floats on the water, allowing the water to be removed therefrom. Subsequently additional water is then removed. The pretreated gasoline coal slurry is finally mixed with a bunker heating oil; that is to say, a heavygrade heating oil. This mixture is next heated. This heating process vaporizes the gasoline or light petroleum fraction for which, as with the other materials which have been washed from the gas, a use can be found. The mixture of coal slurry and commercial grade bunker heating oil is then fed back to the gasification reactor where it is gasified.

From the German Pat. No. 12 16 259 it is also known that a small portion of the ash content of the gaseous products of reaction falls to the bottom of the quencher or scrubber immediately upon contact with the water and automatically forms a sintered product at the bottom of the barrel thereof which is then removed therefrom. The portion of the solid matter discharged from the reactor which does not react in the water to form sintered ash is later fed back to the gasification reactor where the carbonaceous material therein is once again attempted to be gasified. However, of course, ash is also fed back without any particle separation, causing a detrimental effect on the reaction in the gasification reactor.

Particle size separation has been well known for many millennium. Particles have been separated by size with the use of sieves since virtually time immemorial. When the materials to be sieved generate a great deal of dust, it is common to wet these materials down before the sieving operation in order to reduce the dust generated thereby. Another method of separating particles according to size which is used in the treatment of all sorts of ores is the use of a mixture of the ore and water or possibly some other liquid. The water containing the ore is then fed into a chamber containing the same type of liquid with which the ore is mixed, and the mixture is moved across the top of the chamber whereby the largest and heaviest particles sink the fastest and arrange themselves relatively closely to the input of the mixture to the chamber, whereas the smaller and lighter particles are precipitated farther and farther away from the inlet. Therefore, particles of ore or any other particulate matter can be separated into different sizes from large particles close to the inlet to very fine particles which leave the stream far from the inlet. These particles can be collected at different portions of the settling chamber and are often used for different purposes in the preparation and processing of the ore by various methods.

SUMMARY OF THE INVENTION

This invention relates to a method and apparatus in a carbon material gasification process which feeds back particles which have been removed from the reacted gas, and which particles have predetermined parameters. These particles of predetermined parameters are then fed back into and mixed with the pulverized carbonaceous feed stock to be fed into the reactor. The remainder of the particles which do not meet the requirements of these predetermined parameters may be treated in such a way as to make them more closely acceptable from the standpoint of these parameters. Also, the solids which are discharged from the reactor with the gas may be treated and processed in such a manner as to make a larger portion thereof conform to the predetermined parameters. Yet further, particles which are not able to conform to these predetermined parameters may also be used in a separate and distinct gasification process.

The predetermined parameters comprise at least the size thereof if passed through a mesh. Particles of a certain size range, preferably from a predetermined mesh size down to a smaller size range, are fed back for mixture with the feed stock.

In an embodiment of the invention the particles of unburnt or partially burnt carbon are treated to reach an optimum size range. Any size below a predetermined mesh size of the carbonaceous particles is believed to be satisfactory for the operation of the process, and so is reused for combustion or reaction after mixing with the feedstock slurry.

This invention does not simply consist in merely indiscretely feeding back particulate carbon material recovered from the flue gases. Indiscrete feedback of recovered carbon into the feedstock does not result in the lowest ash production ultimately and does not result in the maximum thermal efficiency for coal gasification. It has been found that it is possible to optimize the feedback process to result in the lowest ash production for a given variety of coal and operating conditions. A high ash content formation is not only wasteful from the point of view of coal utilization, but is also deleterious since ash tends to wear out equipment which includes separators, pipes, pumps, valves, etc. It has been found experimentally that if the particulate size of the fed-back carbon recovered from the gases is limited to a predetermined size range, then the ash generation is minimized and the process optimized. Sorting of carbon particulate sizes by wet-separation reduces component wear by ash, and facilitates ash removal.

Significantly, if carbon particles which seem too large and recovered from gases are recirculated for combustion, the ultimate ash production in the reactor goes too high, which fact has not been recognized in any prior art citations. The reason for a resultant high ash content and other damage is that seemingly large carbon particles recovered from gases almost invariably contain trapped ashes; such seemingly large particles if circulated back into the reactor without size separation and treatment, will mean that an unnoticed quantity of trapped ash is undesirably recirculated; this is very deleterious and increases the total ash content, and is wasteful from the efficiency point of view.

On the other hand, if recovered carbon particles of exclusively too small a size are recirculated, then, also, it is found by the applicants that ash formation ultimately is significant; the cited references are totally unaware of this fact, too.

Only a complete understanding of the criticality of the returned particulate carbon size and the knowledge of the undesirability and consequential harm done by indiscrete carbon feedback will give an appreciation of this invention. Additionally, in this invention, by treatment of the recovered particulate carbon with a predetermined grade of hydrocarbon fluid, usable carbon particles which are too small for recirculation cling together and fall into the usable range. Hydrocarbon treatment per se of particulate carbon is not new in the art and has been extensively previously used; however, in prior art arrangements, hydrocarbon treatment is resorted to in merely imparting flotation to carbon particles in a slurry, so as to enable their separation. In the method of the present invention, fluid hydrocarbon treatment is used to facilitate slag separation, at the same time to enable smaller carbon particles to cling together just enough to fall into the usable range for purposes of feedback into the reactor without producing undue ash formation. The method step of hydrocarbon treatment just prior to particulate size separation increases the carbon material percentage which can fall under the "acceptable for feedback" category according to our invention.

DESCRIPTION OF THE PREFERRED EMBODIMENT

Figure 1:
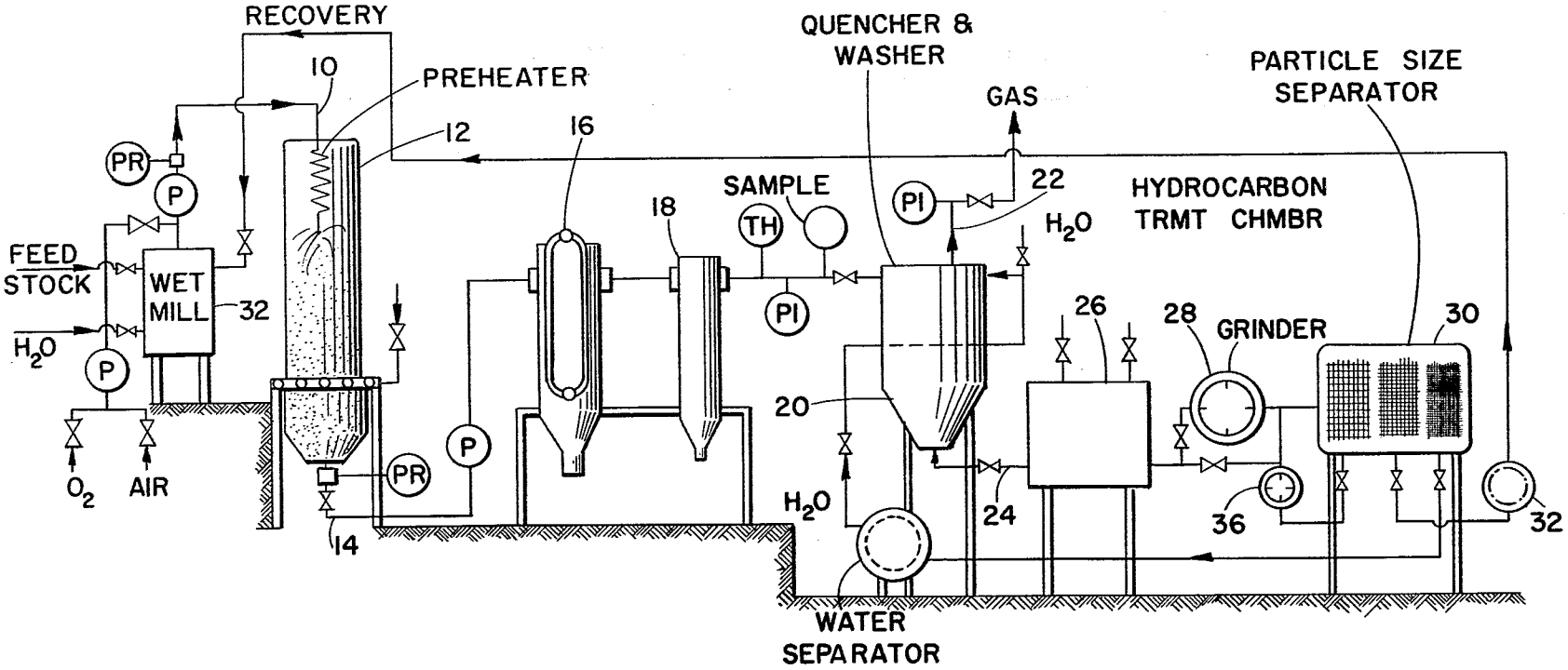
FIG. 1 shows a gas coal gasification arrangement having equipment operated according to the invention.

Referring to FIG. 1, a typical coal gasification arrangement is shown with an embodiment of the present invention incorporated therein. Feed stock 10 which may be preheated in a preheater, is introduced into a reactor cylinder 12. The pulverized feed stock 10, preferably made up of pulverized coal, is reacted with oxygen and water vapor in a unitary flow direction in this example of the reactor 12, from the top to the bottom thereof. The feed stock and the other components which partake in the reaction thereof may comprise water which has been vaporized in the feed stock and oxygen preferably from the air. The reaction within the reactor body 12 is very rapid, such that the feed stock and other components traverse the combustion zone therein within a few seconds. During the combustion process a gas containing hydrogen and carbon monoxide, which is highly desirable for the manufacture of synthetics is generated, together with ash and unburned components of the feed stock as is well known from the prior art. The components of combustion in the reactor are removed therefrom by the conduits 14. As an example of a typical process, the combustion products are fed through a waste heat remover 16. However, this waste heat remover 16 is shown only for illustrative purposes in order to more clearly illustrate a typical process in which the invention may be applied. The combustion product may then be fed from the waste heat remover 16 to a feed water heat exchanger 18, in which heat is extracted from the combustion products, which are then fed to a scrubber 20 into which water is injected to quench and wash the solid products of the gasification in the reactor 12 from the gaseous product of combustion. The gaseous products of combustion which are typically to be used for the purpose of synthesis of other materials are removed by a pipe 22 and removed from the instant process for use elsewhere, not shown. The water washes out the unburned products of combustion such as coal particles and ash from the gas. At least a portion of the wash water from the scrubber 20 forms a slurry of wash water and carbonaceous materials with ash included therein. This slurry is then fed via a conduit 24 in an alternative embodiment of the invention into an oil-mixing chamber 26 which will be described in greater detail later. The slurry is then removed from the oil-mixing chamber 26 and may be fed to a grinder 28 or bypassed from the grinder 28. The slurry is now fed into a particle size separator 30 which includes a series of compartments, each in one embodiment, having mesh at the bottom thereof for separating out particles of a specific size. It will be noted that the slurry, as it is fed across the top of the separator 30 at a substantially constant speed, will facilitate the precipitation out of particles of different sizes at different positions in the bottom of the separator 30. In other words, the larger size particles will precipitate out towards the left-hand side of the separator 30 since they will sink most rapidly from the stream of slurry passing across the top of the separator 30 from left to right. The finer particles will separate out towards the right half of the separator 30 and the medium-size particles will separate out in between the large and the small particles. The particles are then removed from the particle size separator 30 and a certain predetermined size of particle is fed back to the reactor 12 where the particles of a predetermined size are mixed with the feed stock 30 for reintroduction into the reactor 12 as described supra. Before the particles of a predetermined size are reintroduced into the feed stock 10, they are preferably processed in order to reduce their water content, for example in centrifuge 32. Other means of removing some of the water from the separated slurry discharged from the particle size separator 30 and then cetrifuging are equally applicable in order to prepare the recovered particles of predetermined size for mixture with the feed stock 10.

One of the problems in the prior art has been the increase in the ash content of recovery stock and then of the combined recovery stock and the feed stock 10 fed through the reactor 12. In the prior art, the ash content of the solid material in the slurry has been about 40% which impedes the operation and overloads the various elements in the process. In addition, the ash is extremely abrasive and may cause excessive wear of any and all of the components with which it makes contact in the plant as shown in FIG. 1. Attempts have been made in the prior art to reduce any physical contact of the apparatus with the recovery material by reducing the processing of the highly abrasive ash, but, undesirably wasting any associated carbonaceous material.

In the present invention, the remarkable fact has been observed that by separating the particles in the slurry into a predetermined particle size of 63 microns or less, and recycling only particles 63 microns and less the ultimate ash content of the solid portion of the combusted product can be reduced from 40% to a surprisingly low 13%. It is believed that as the particle size decreases, the ash content thereof also decreases, which is a surprising and unexpected result.

The construction of the particle-size separator will now be described in detail in FIG. 2. The particle-size separator 30 is shown in greater detail having a conduit 110 for introduction of the slurry above the bottom portion 112 thereof. As the slurry is propelled into the separator 30 preferably at a substantially constant speed across the top thereof, the heaviest particles, that is the largest particles, sink first at the left-hand portion thereof, and the smaller particles sink farther to the right since their sink rate is less than that of the larger and heavier particles. Baffles 114 are provided to separate the particles into various sizes. Three areas are shown separated by two partitions 114. However, there may be only one baffle 114 to separate the particles in an alternative embodiment. In other words, the particles may be separated from roughly 63 microns and smaller and 63 microns and larger. However, as will become apparent infra, there may be more baffles in order that the particles can be separated into different sizes such that they can be processed in different ways depending upon their size.

Alternatively, a dry sifting system comprising sieves could be used instead of the wet separation in the particle size separator 30. Of course, this would require a modification of the slurry into a somewhat more solid material which would be more easily separated by using mesh. However, the best mode of practicing the invention is believed to be the use of wet separation.

Figure 2:
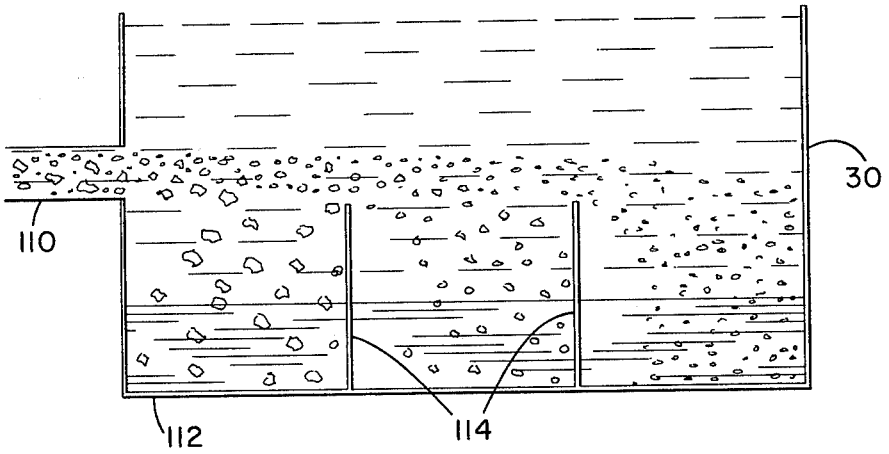
FIG. 2 shows a particle size separator according to an embodiment of the invention.

In the preferred embodiment, the separation, as shown in FIG. 2, is thought to be preferred.

It should be noted that the significant reduction in ash content of the solids produced by the reaction permits the use of the particle size separator 30 which is shown in FIG. 2; that is to say, a wet separator. The wet separator reduces ash content by allowing the recycling into the reactor, of particles of a predetermined size and no larger; in this case, in the preferred embodiment, 63 microns or smaller.

In addition, the reduction of the ash content greatly facilitates the use of the separator 30 such as the wet separator or even a mesh-type separator, because the reduction in ash content provided by the use of the separator 30 in the process also reduces the wear factor of the separator 30 and the grinder 28 and makes the process far more reliable and economical than would be possible using any of the prior art methods. This double advantage of reduction in ash content by using the separator 30 and the reduction in the wear of the components in the process, especially the separator 30 and the grinder 28, provides a dual startling result which can be nothing other than completely unobvious to anyone skilled in the art.

Yet further, because of the small size of the particles which are fed back in the process, the ash may be far more readily removed by the water which is used to quench and scrub the product of combustion in the scrubber 20. So, even further, the wet separation of the particles also facilitates the removal of the ash by the use of the water in the formation of the slurry, which water removes the ash. At least when the water is removed from the slurry in the centrifuge 32 in order to prepare the recovered material for mixture with the feed stock 10, the ash content is additionally reduced. Therefore, the ash is removed from the feed-back loop and the continuous circuit of feed-back material being fed through the process again and again is greatly reduced. The particle-size separation 30 provides this substantial advantage that surprisingly lowers the ash content and therefore lowers the wear of all components in the process, especially the particle-size separator 30 and the grinder 28. Unburnable material in the carbonaceous minerals are therefore substantially removed from the gasification process; the unburnable materials have been a substantial cause of problems in the past, and have been a material limitation to applicability of coal gasification as a commercially viable alternative to the production of gases having a high content of carbon monoxide and hydrogen for use in the production of synthetic materials.

In an embodiment of the invention, hydrocarbons in liquid form, such as heating oil or bunker oil and preferably heating oil generally available in Germany and classified as heating oil EL, are mixed with the slurry in the oil-mixing chamber 26. The liquid hydrocarbon is carefully mixed with the water-carbon slurry in order to coat the particles thereof and then the slurry is passed through the particle size separator 30 as described above. This process of adding a liquid hydrocarbon, as described above, improves the operation of the process it is believed, by coating the carbonaceous material because of the affinity of one hydrocarbon for another or of one carbon compound for another as described above. In the oil-mixing chamber 26 the particles comprising the carbon containing a portion of the slurry are completely wetted by the careful and complete covering of the surfaces of the particles by the fluid hydrocarbon, such as the oil as described above; the oil treatment, because of usable carbon particles clinging, together, facilitates slag removal.

Further, unburnt carbon particles lump together when they leave the reactor; that is to say, larger particles are formed by small particles coalescing into larger particles and lumping together during partial combustion in the reactor 12. During the formation of the larger particles by agglomeration, ash or the slag-like residue which forms part of the solid portion of the discharge of the combusted or partially combusted materials from the reactor 12 is trapped within the large particles. These large particles are removed with the water through the sieving or separating operation in the particle size separator 30. Surprisingly, the surface characteristics of the carbonaceous minerals used in the present process are not changed even through the gasification, or more appropriately, partial gasification thereof in the reactor 12. From the solids removed from the gas stream by scrubbing in the scrubber 20, the solids are concentrated; that is to say, the viscosity thereof, or the solid component portion thereof, as a slurry is increased preferably, in the present invention, by a water separator 34 connected preferably to the scrubber 20. However, of course, the water separation may be accomplished by a water separator 32 such as a centrifuge which is located in a different position in the chain of the process. This position may be after the scrubber 20. According to the invention, the oil is mixed to be as small a portion as possible to provide complete wetting of the particles.

The concentration of the slurry is typically in the range of 200 to 500 grams per liter, and more preferably has been found in this process to have a concentration of 350 grams per liter. After the step of thickening the slurry mixture, heating oil such as West German EL heating oil, is mixed to a ratio of between 5% and 20% by weight of the entire product at the point of and in the oil-mixing chamber 26. Preferably, the oil is mixed to obtain a ratio of between 8% and 10% by weight compared to the solid content of the product at that point.

The agglomeration hereinbefore described is exclusively dependent from the carbonaceous substances and the preparation of the similar and substantially constant characteristics of the surfaces of these particles. Therefore, the portion of the slurry containing the carbonaceous agglomerated particles, unburnable solids and water, are separated by the separating or sieving operation, as described in the operation of the particle size separator 30, and, for example, being sieved or separated to the size of 0.5 millimeter and then the obtained separated material is fed back again and mixed with the feed stock 10. Alternatively the agglomerate may be ground with the slurry and separated to the size of 0.1 millimeter.

The agglomerated particles are separated in order to reduce the ash content, as previously described, and may be passed through a separation procedure or process such as that disclosed above in the particle size separator 30 and thereby remove the agglomerated particles from the slurry above. The agglomerated particles may either be ground into a finer particulate matter or they may conceivably be used in another coal gasification process such as the Lurge Process.

The use of the oil to completely wet the carbonaceous particles is believed to facilitate the separation of particles which do not have a desirable carbonaceous content from the carbonaceous particles.

In order to improve the operation of the reactor in an alternative embodiment of a portion of the invention, the particles are ground in a mill 36 so that they can be reduced in size to less than 0.1 millimeters whereby the separation process is improved through an optimum wetting of the particles.

Under certain circumstances, another aspect of the invention provides for preparing fuel for the operation of a Lurge reactor. The residues from the carbonaceous portion of the solids which are fed back after being removed from the gas may be used in a different manner for a commercially viable process whereby the particles, especially the larger ones in the slurry, are processed to remove the water therein and then mixed with a binder which binds the particles one to the other and then finally compressed into lumps or briquettes which may preferably be the size of a fist. These briquettes may be, for example, fed into a blank bed gasification unit and therein gasified.

What is claimed is:

1. A method in gasification of a feed-stock containing water-carbonaceous material slurry comprising the following steps:

a. reacting a water-carbonaceous material slurry with oxygen in a reactor to form a product gas containing solid material comprising unburnt carbon particles and ash;

b. removing said product gas and said solid material from the reactor;

c. treating said gas and solid material with water to remove the solid material from the gas and to form a slurry of water and the solid material;

d. treating said slurry of water and solid material with an oil additive to cause oil-wetting and cause particulate agglomeration of particulate carbon in said solid material, and consequently to facilitate separating ash from said unburnt carbon particles;

e. separating agglomerated unburned carbon particles having a predetermined mesh size range from said slurry such that the carbon particles separated have a substantially decreased ash content by admitting the slurry with a horizontal velocity into a container for separation of particulate sizes, using substantially vertical baffles in the container; and f. feeding back the separated carbon particles of said predetermined mesh size to the reactor for being reintroduced into the reactor with the feed stock, whereby abrasive wear in the reactor is reduced because of reduced ash feedback in the carbon fed back to be mixed with the feed stock.

2. The method as in claim 1 wherein the step of separating said agglomerated unburned carbon particles by separation of particulate sizes comprises wet separation by letting in said slurry of water and said solid material with a horizontal velocity into a tank containing three substantially vertical baffles.

3. The method as in claim 2 wherein separation by particulate sizes consists in sorting particles of 63 micron mesh size for return to mix with said feedstock, and particles above 63 micron mesh size to be dewatered and subjected to further size reduction by grinding.

4. The method as in claim 1 which includes a step of water removal and thickening of the slurry containing water and said carbonaceous solid material, prior to the step of treating with a fluid additive, the thickening being to achieve a carbonaceous solid material weight of between 200 and 500 grams/liter of the slurry.

5. The method as in claim 4 wherein the thickening is to achieve a carbonaceous material weight of 350 grams/liter.

6. The method as in claim 4 wherein the step of treating with a fluid additive comprises thickening by adding sufficient weight of commercial heating oil and mixing thoroughly so as to gain a weight increase of between 5% and 20%.

7. The method as in claim 6 wherein the commercial heating oil is German EL grade, and the weight increase is between 8% and 10%.

8. The method as in claim 6, wherein the predetermined mesh size for particulate size separation is 0.5 mm.

9. The method as in claim 6, including the step of grinding the thickened slurry to achieve a particulate size of 0.1 mm.

10. The method as in claim 6 including the step of treating particulate carbon which is of a size other than said predetermined size, with a binder material after washing, and subsequently compacting into any required shape for further use.

11. A method of gasification of a feedstock containing water-carbonaceous material slurry, comprising the steps of:

a. reacting the slurry with oxygen in a reactor to form a product gas containing entrained particulate solid material containing carbon particles and ash;

b. scrubbing said product gas with water to form scrubbed clean product gas and a slurry of water together with solid material;

c. decreasing the water content of said solid material;

d. treating said water-solid material slurry with a known grade of oil additive to facilitate agglomeration of carbon particles and to facilitate separating ash;

e. subjecting the treated water-solid material slurry by admitting said slurry under horizontal velocity into a container to cause wet particulate separation in said container using substantially vertical baffles, to obtain carbon particles of a predetermined mesh size such that the carbon particles obtained have a substantially decreased ash content; and f. feeding back carbon particles of said predetermined mesh size to be mixed with said feedstock for carbon recovery.

12. The method as in claim 11 including the step of grinding separated particulate carbon particles which are of a size bigger than said predetermined mesh size.

13. The method as in claim 11, wherein the step of decreasing the water content is so as to achieve a carbonaceous solid material weight of between 200 and 500 grams/liter of the water-solid material slurry.

14. The method as in claim 13 wherein the weight is 350 grams/liter.

15. The method as in claim 11 wherein the step of treating comprises thickening the slurry by adding sufficient weight of commercial heating oil and mixing, so as to gain a weight increase of 5% to 20%.

16. The method as in claim 15 wherein the commercial heating oil is German EL grade, and the weight increase is in the range of 8% to 10%.

17. The method as in claim 16 wherein the predetermined mesh size is 0.5 mm.

18. The method as in claim 16 which includes the step of grinding the thickened slurry to a size of 0.1 mm.

19. The method as in claim 11 wherein the step of decreasing the water content comprises using a centrifuge water separator.

* * * * *